US005426267A

United States Patent [19]

Underhill et al.

[11] Patent Number: 5,426,267

[45] Date of Patent: Jun. 20, 1995

[54] HIGHWAY AND AIRPORT SOUND BARRIERS

[76] Inventors: George R. Underhill, 96 Glen Oaks; Bruce T. Barit, 8410 Avonside Ct., both of E. Amherst, N.Y. 14051; Edward A. Landers, 6359 W. Sixteenth Ave., Hialeah, Fla. 33012

[21] Appl. No.: 125,297

[22] Filed: Sep. 22, 1993

Related U.S. Application Data

[63] Continuation-in-part of Ser. No. 972,254, Nov. 5, 1992, abandoned.

[51] Int. Cl.[6] ..... E04H 17/00

[52] U.S. Cl. ..... 181/210; 181/286; 181/290; 52/144

[58] Field of Search ..... 181/210, 285, 286, 287, 181/288, 290, 294; 52/144, 145

[56] References Cited

U.S. PATENT DOCUMENTS

| | | | |
|---|---|---|---|
| 3,898,776 | 8/1975 | Cox et al. | 52/79 |
| 4,092,811 | 6/1978 | Lin et al. | 52/224 |
| 4,136,856 | 1/1979 | Murdock | 256/24 |
| 4,143,495 | 3/1979 | Hintz | 52/145 |
| 4,325,457 | 4/1982 | Docherty et al. | 181/210 |
| 4,558,850 | 12/1985 | Melfi | 181/210 X |
| 4,566,558 | 1/1986 | Link, Jr. et al. | 181/210 |
| 4,605,090 | 8/1986 | Melfi | 181/210 |
| 4,838,524 | 6/1989 | McKeown et al. | 181/210 X |
| 4,862,992 | 9/1989 | Melfi | 181/210 |
| 4,887,691 | 12/1989 | Rotondo | 181/210 |
| 4,899,498 | 2/1990 | Grieb | 52/144 |
| 5,268,540 | 12/1993 | Rex | 181/210 |
| 5,272,284 | 12/1993 | Schmanski | 181/210 |

*Primary Examiner*—Khanh Dang

*Attorney, Agent, or Firm*—Ware, Fressola, Van Der Sluys & Adolphson

[57] ABSTRACT

An elongated outdoor acoustic barrier for erection along a roadway or the periphery of an airport, for reflecting and absorbing sounds emanating from the roadway or airport, includes a plurality of substantially vertical columns arrayed at spaced intervals along the barriers' length, each having a recessed groove extending along its exposed above-ground lateral surface facing an adjacent spaced column; and a plurality of elongated flat rectangular panels arranged in a vertical edgewise array at least one panel in height, having opposite panel ends each securely embraced in a respective recessed grooves of a pair of adjacent columns, at least one of said panels being formed of extruded prestressed hollow core concrete plank.

20 Claims, 6 Drawing Sheets

HIGHWAY AND AIRPORT SOUND BARRIERS

This is a continuation in part of application Ser. No. 07/972,254 filed on Nov. 5, 1992 now abandoned.

FIELD OF THE INVENTION

This invention relates to highway and airport sound barriers, outdoor walls projecting upward fifteen to thirty feet to absorb and diminish or reflect vehicle noise, often incorporating sound absorbing materials to reduce the impact of traffic or aircraft noise on surrounding neighborhoods.

RELATED ART

Sound barriers of wood, reinforced concrete or plastic materials, or combinations of these materials, have been erected beside airport runways and highways in many parts of this country. They may be zig-zagged serpentine structures, although many such barriers are high, substantially flat walls, formed with vertical columns spaced apart along the length of the barrier supporting sound-absorbing or sound-reflecting flat vertical panels arrayed between the columns.

United States patents illustrating various sound absorbing and sound reflecting or blocking structures include the following: U.S. Pat. Nos. 4,899,498; 4,838,524; 4,605,090; 4,566,558; 4,558,850; and 4,136,856.

SUMMARY OF THE INVENTION

The sound barriers of this invention employ H-cross section vertical columns, preferably of reinforced concrete or structural steel, with their lower ends embedded in caissons buried underground extending fifteen to twenty feet deep. These columns have their upper ends projecting fifteen to thirty feet above the earth's surface. The crossbars of the H are generally positioned to form column webs aligned substantially perpendicular to the source of sound, such as the adjacent roadway, with the flanges of each H cross section column extending parallel to the roadway and forming between themselves a vertical groove facing the next adjacent column, which may be twenty, twenty-five, or thirty feet away. One, two, three or four elongated thin flat panels forming the structure of the sound barrier extend lengthwise from the lateral groove on one side of a column of this assembly parallel to the roadway into embraced engagement in the facing vertical groove of the next adjacent vertical column.

Accordingly, a principal object of the present invention is to provide novel sound barriers for outdoor installation beside highways or airport runways which are effective and highly economical in construction.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be made to the following detailed description taken in connection with the accompanying drawings, in which.

Figure 7:
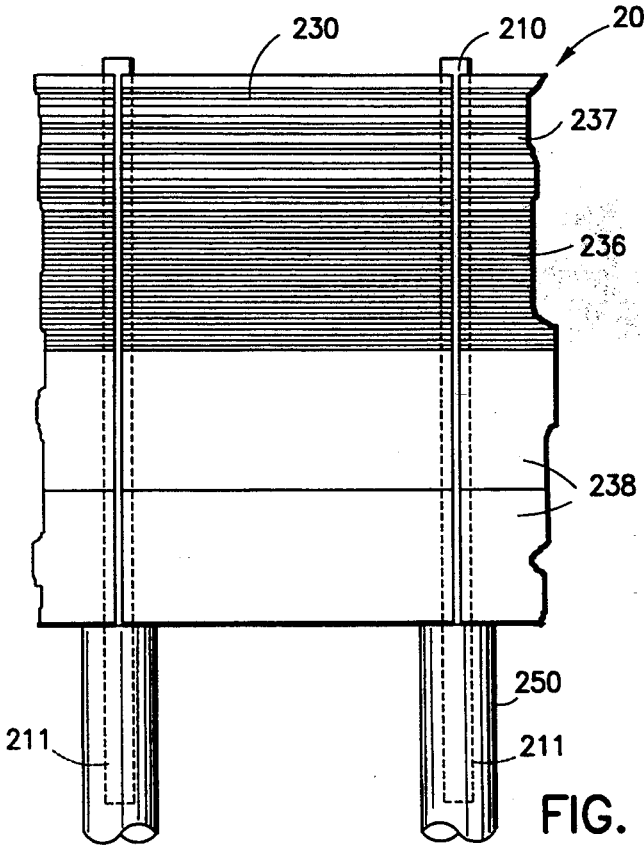
FIG. 7 is a front view of another embodiment of a sound barrier 200 of the present invention.
Figure 9:
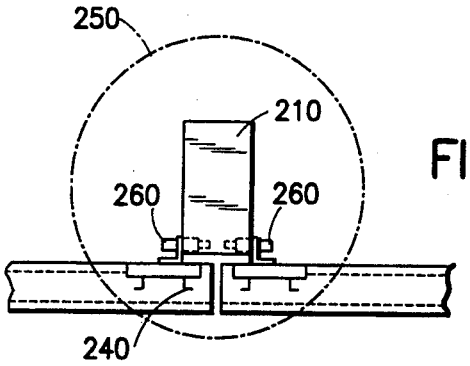
Figure 10:
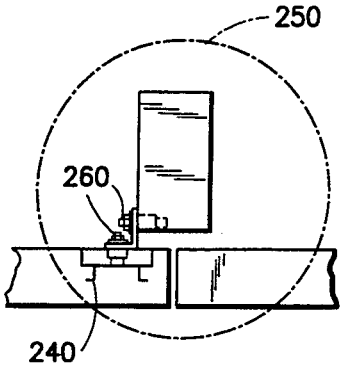
Figure 11:
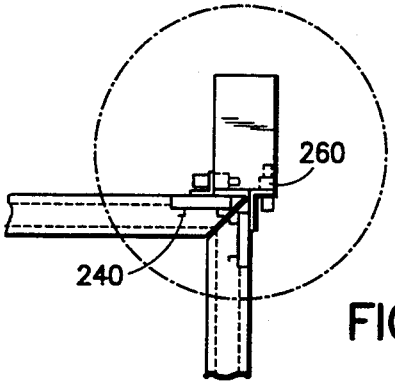

FIGS. 9–11 show a means for connecting panels 230 to a column 210 shown in the sound barrier 200 in FIG. 7.

Figure 12:
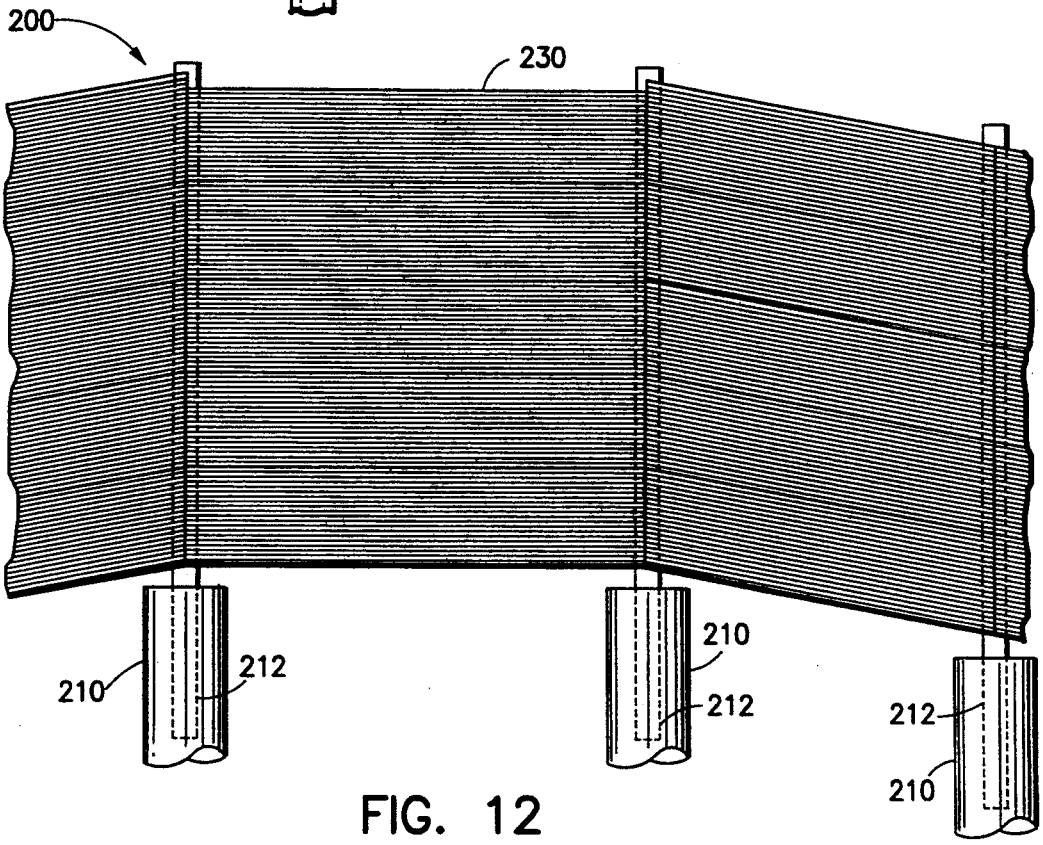

FIG. 12 is a view of a sound barrier 200 constructed on contoured landscape.

Figure 13:
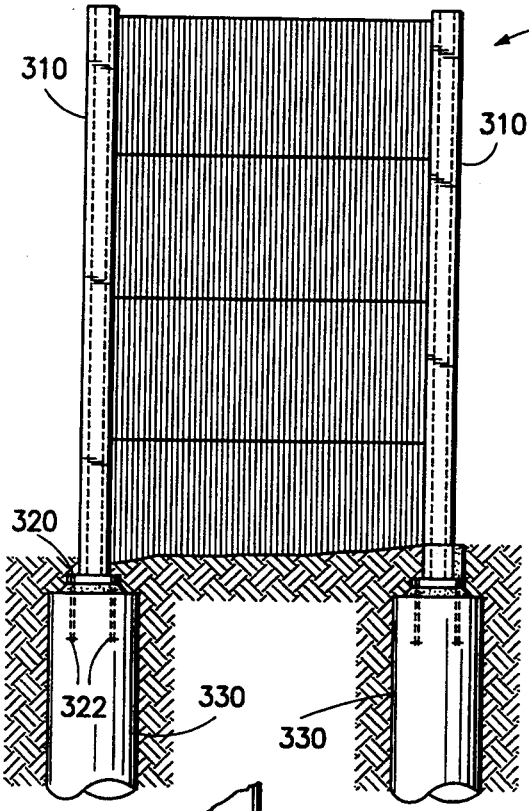

FIG. 13 is another embodiment of a sound barrier 300 of the present invention.

Figure 14:
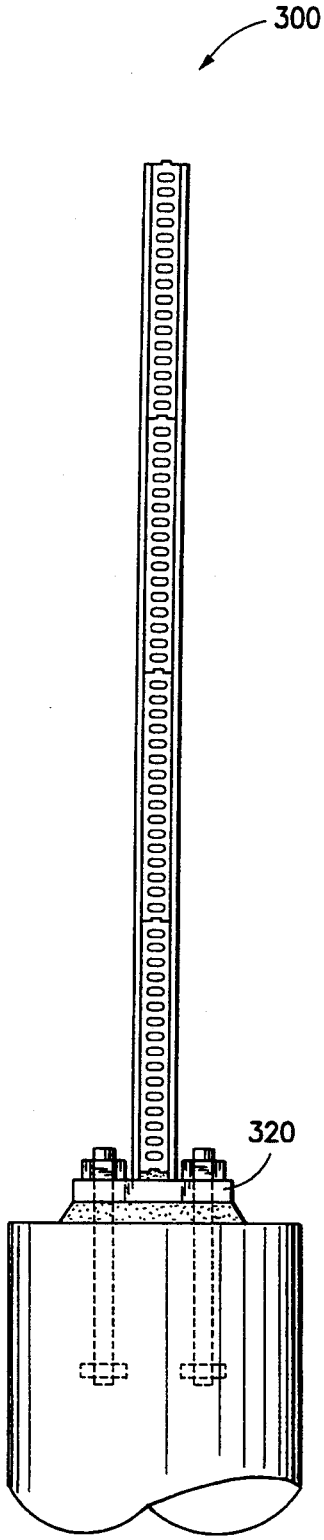

FIG. 14 is a side view of the sound barrier 300 in FIG. 13.

Figure 15:
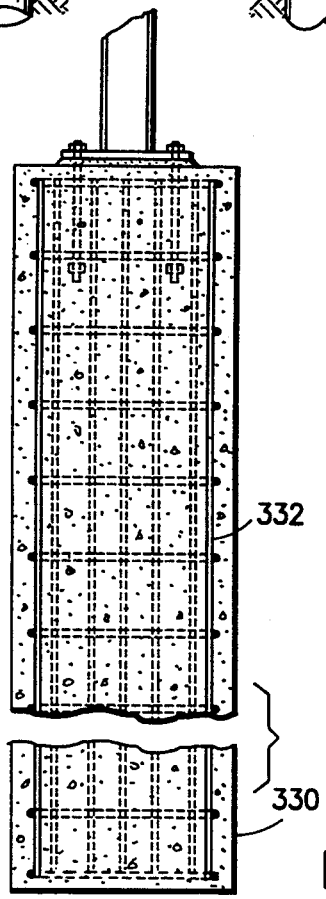

FIG. 15 is an alternative embodiment of the sound barrier 300 in FIG. 13.

Figure 16:
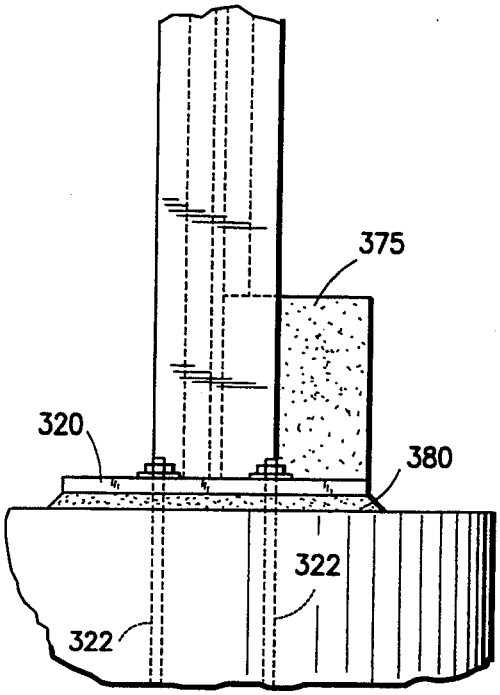

FIG. 16 is a partial view of a column 310 of the sound barrier 300 in FIG. 13.

Figure 17:
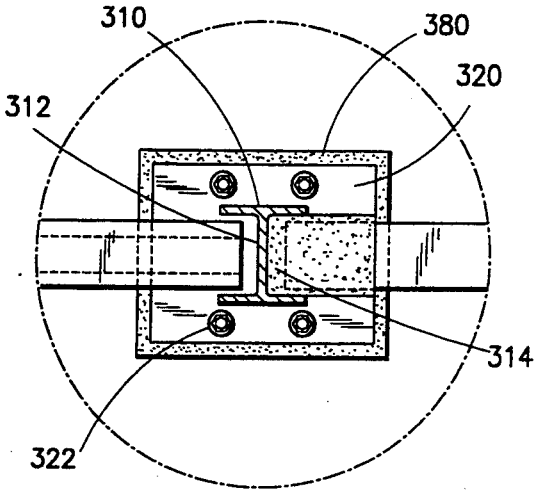

FIG. 17 is a plan view of a column 310 of the sound barrier 300 in FIG. 13.

Figure 18:
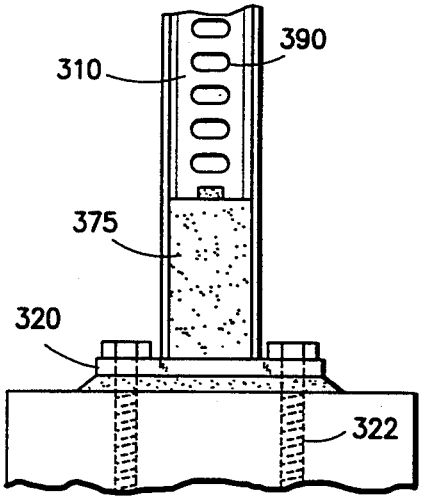

FIG. 18 is a partial side view of a column 310 of the sound barrier 300 in FIG. 13.

Figure 19:
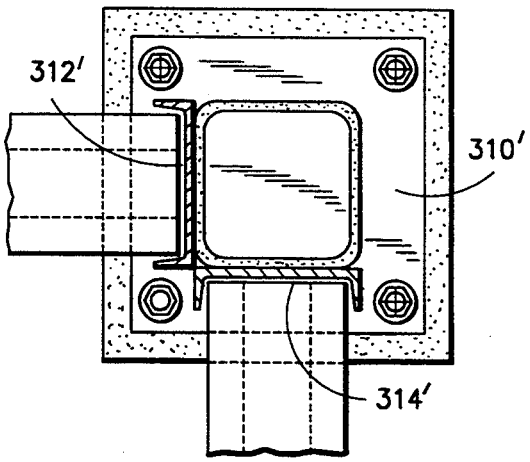

FIG. 19 is a plan view of a corner column 310' of the sound barrier 300 in FIG. 13.

Figure 20:
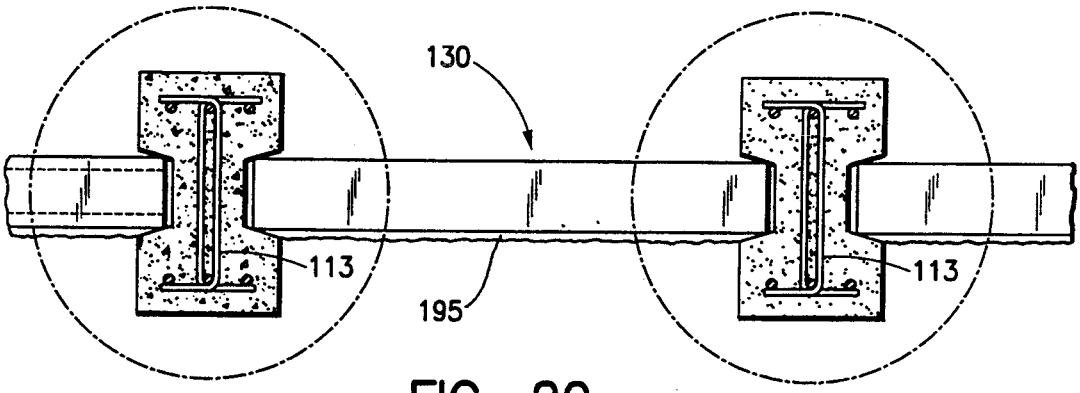

FIG. 20 is a end elevation view of an alternative embodiment of the sound barriers 100, 200, 300 shown in the FIGURES able.

Figure 21:
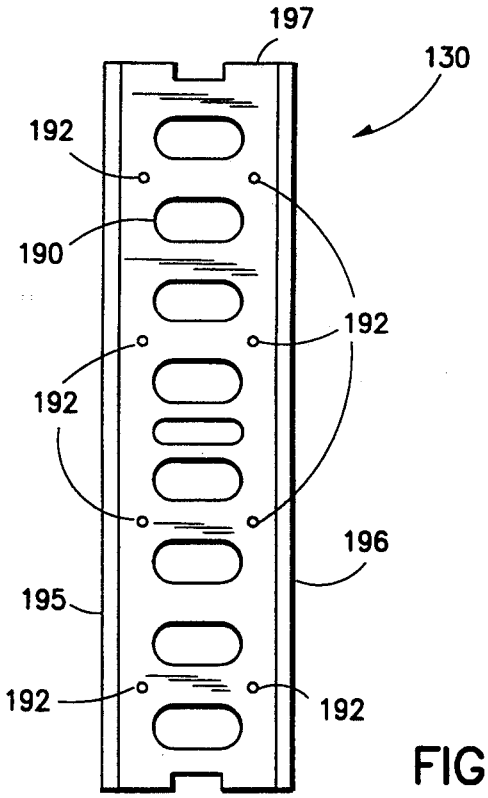

FIG. 21 is a diagrammatic fragmentary end elevation view of the sound barrier 130.

BEST MODE FOR CARRYING OUT THE INVENTION

The invention features an elongated outdoor acoustic barrier for erection along a roadway or the periphery of an airport, for reflecting and absorbing sounds emanating from the roadway or airport.

In one embodiment shown in FIGS. 1–6, a sound barrier 100 has a plurality of substantially vertical columns 110 arrayed at spaced intervals along the sound barriers' length. Each column 110 has a recessed groove 112, 114 (FIGS. 4 and 5) extending along its exposed above-ground lateral surface facing a corresponding recessed groove of an adjacent spaced column 110. The sound barrier 100 also has a plurality of elongated flat rectangular panels 130 arranged in a vertical edgewise array at least one panel in height, having opposite panel ends **130*a*, 130*b* each securely embraced in a respective recessed grooves (FIGS. 4 and 5) of a pair of adjacent columns 110**.

Figure 1:
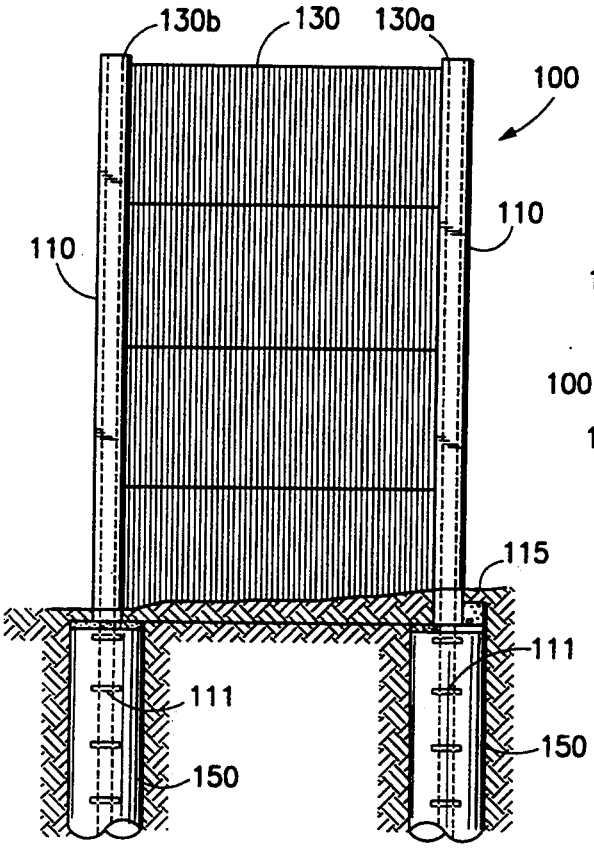
FIG. 1 is a front view of a sound barrier 100 of the present invention.

The reinforced concrete columns 110 respectively have their lower ends firmly anchored in large cylindrical concrete caissons 150 which are typically 2.5'–3.5' in diameter for example, and extending downward up to twenty-five feet or more into the earth. The upper end of each caissons 150 may be at grade level or may itself be buried four to eight feet below the earth's surface, which may be banked upward in a berm extending along the path of the sound barrier 100. The line 115 illustrates the upper surface of such an earthen berm in FIG. 1. Above berm 170, columns 110 may extend upward as high as thirty feet, for example, and the above ground portion of the structure is best shown in FIG. 1. As shown in FIG. 1, the one bottom edge of the column 110 extends into ground cover about one foot, and the ground cover would normally have a finished grade.

As shown in FIG. 1, each column 110 is a reinforced concrete post having an extending reinforced cage 112 embedded in the caisson 150. Typically, the reinforced cage 111 extends six feet and six inches into the caisson 150.

Figure 2:
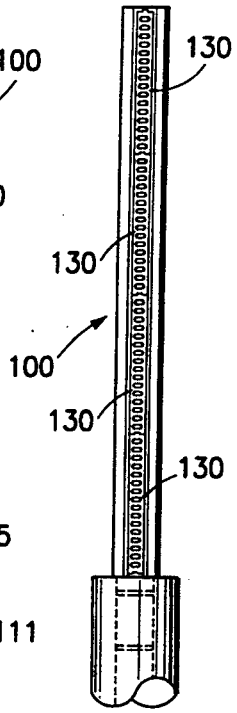
FIG. 2 is a side view of the sound barrier 100 in FIG. 1.
Figure 2A:
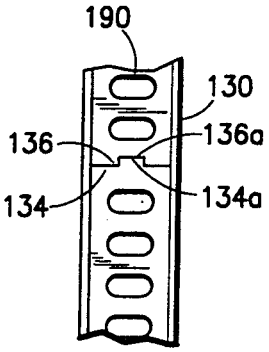

As shown in FIGS. 2 and 2*a*, each panel 130 has a tongue 134*a* on one edge 134 and a groove 136*a* on its opposing edge 136 for firmly holding two or more panels in place when they are stacked one on top of another.

Figure 3:
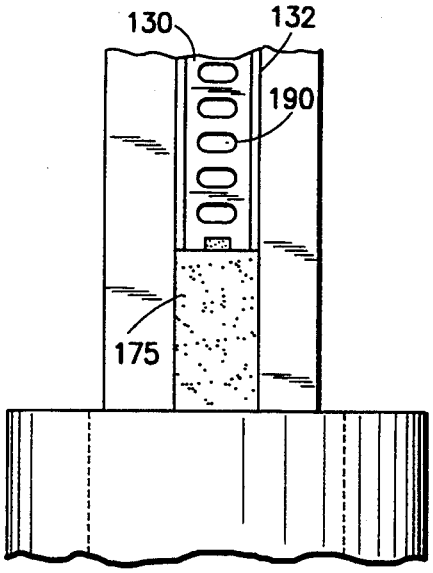
FIG. 3 is a partial side of the sound barrier 100 in FIG. 1.

As best shown in FIGS. 2, 2*a* and 3, each panel 130 is preferably an extruded pre-stressed hollow core concrete panel, as indicated by the substantially elliptical hollow spaces or passages 190. Each of the panels 130 is an extruded pre-stressed hollow core concrete panel having a plurality of substantially parallel longitudinal hollow spaces also known as passages 190 extending throughout and having a plurality of prestressed reinforcement strands 192 (as shown in FIG. 21) embedded therein and arranged between adjacent pairs of the substantially parallel longitudinal passages 190. Each panel 130 is made from a high-strength mix. The panel may have three different mixes, one on each face 195, 196 and a structural core 197 as show in FIG. 21. One face 195 which faces the source of the sound S may be made up of a sponge-like characteristic for good sound absorption. The other face 196 which does not face the source of the sound S may be treated by anything, such as being colored, broomed, raked or ribbed for decorative purposes.

The absorptive face 195, if used, is a concrete mix consisting of light weight sound, cement, and aggregate, and having a high level of air to create voids. This combination normally produces concrete weighing about 150 pounds per cubic feet. The newly developed concrete will weigh about 75 pounds per cubic feet, and has a noise reduction factor of at least about 0.5, and preferably about 0.8 to 0.85. This concrete will not have the compression strength of the core.

The spaces 190 extend throughout the panel 130 and are shown only in particular portions of the exposed upper edges of panel 130, but it will be understood that these openings 190 formed by the hollow cores during the extrusion process extend along the entire longitudinal length across the width of each panel 130.

As shown in FIG. 1, each panel may have an equally spaced vertically scored pattern 135 for deflecting the sounds emanating from the roadway or airport. The panels 130 may, for example, also have an equally spaced horizontal ribbed pattern 236 (FIG. 7) or a randomly spaced horizontally spaced scored pattern 237 (FIG. 7) for deflecting sound waves. The panels may also have no scored pattern as indicated by numeral 238 (FIG. 7). This feature of the panel 130 can also be used with the other embodiments discussed below with respect to FIGS. 7–19.

In another embodiment, each panel may have a surface layer of sound absorbent material 195 (see above), which may be bonded to the exposed face of each panel 130, facing toward the sound source, as best shown in FIGS. 20 and 21. The use of such sound absorbent material on sound barriers is well known, but the combination of this material with the extremely sturdy and unusually lightweight hollow core panels of this invention, such as an extruded pre-stressed hollow core concrete panel, is believed to be unique and never before suggested.

The sound barrier 100 can be used with or without the sound absorbing material 195. In either case, the barrier 100 provides an extremely low cost barrier, provides better sound absorption or deflection than existing barriers of other materials, has an unusually long useful life, and makes the barriers of this invention highly economical and of unexpected economic value in the construction industry.

The feature of a sound absorbing material on the panel 130 can also be used with the other embodiments discussed below with respect to FIGS. 7–19.

As shown in FIG. 3, the sound barrier 100 may have a nonshrink mortar step 175 which separates a bottom panel 130 and the caisson 150 for raising the height of the sound barrier 100. As shown, the nonshrink mortar step 175 has a height of about one foot and one inch. The feature of the nonshrink mortar step 175 may also be used with the other embodiments discussed below with respect to FIGS. 7–19.

Figure 4:
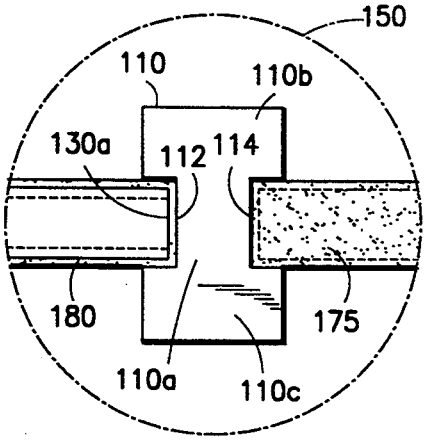
FIG. 4 is a partial plan view of an H-shaped column 110 of the sound barrier 100 in FIG. 1.

As shown in FIG. 4, the sound barrier 100 includes a nonshrink leveling grout 180 with a depth of one inch separates a bottom panel 130 and the caisson 150. The feature of the nonshrink leveling grout 180 may also be used with the other embodiments discussed below with respect to FIGS. 7–19.

Figure 5:
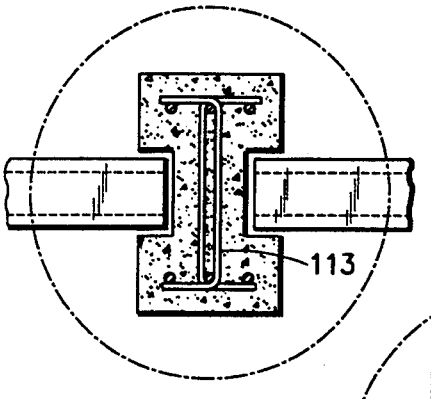
FIG. 5 is a cross-section view of the column 110 in FIG. 4.

As shown in FIGS. 4–5, each H-shaped columns 110 has a thick sturdy cross section formed of concrete, which can be reinforced by suitable conventional rebars 113. Column 110 incorporates a central crossbar web 110*a* and two flanges 110*b*, 110*c* together defining two lateral grooves 112, 114 extending up its entire vertical side surfaces. As shown in FIG. 1, each groove 112 of each column 110 faces the opposed groove 114 of the adjacent column 110, with the flanges 110*b*, 110*c* of the columns 110 embracing the ends of structural panels 130. These are preferably formed as elongated thin flat rectangular panels positioned on edge with their flat ends fitting closely in the recessed grooves 112, 114 of successive columns 110. The recessed grooves 112, 114 are rectangular in shape and have a length of about seven inches and a depth of about three inches. Typically, each panel 130 has a width of about six inches and is extended two and one half inches into the respective recessed groove 112, 114. This leaves room for expansion by the panel 130 of one half inch on all sides of the recessed groove. The shape of the recessed groove 112, 114 may also be non-rectangular as well.

Figure 6:
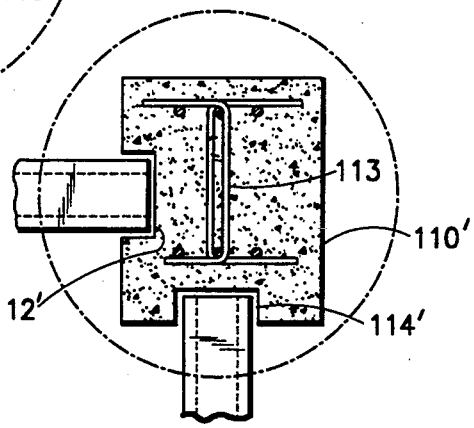
FIG. 6 is a view of a corner column 110' of the sound barrier 100 in FIG. 1.

As shown in FIG. 6, the sound barrier 100 includes a corner column 100' having grooves 112', 114' arranged at a 90 degree angle.

FIGS. 7–12 show an alternative embodiment of a sound barrier 200. In FIGS. 7–12 features similar to the embodiment in FIGS. 1–6 are similarly numbered.

Figure 8:
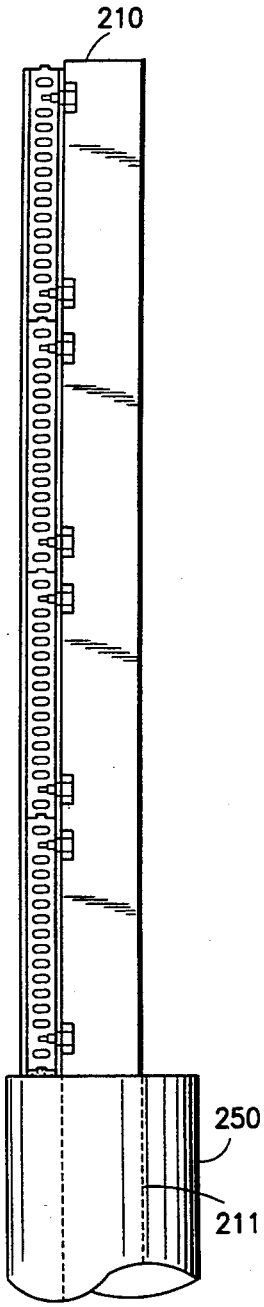
FIG. 8 is a side view of the sound barrier 200 in FIG. 7.

As shown in FIGS. 7, the sound barrier 200 has concrete posts 210, each of which is a precast, reinforced concrete post having a concrete lower end 211 for extending into and being embedded in a caisson 250, typically also about six feet and six inches, or it may be connected with anchor bolts and base plates. FIG. 8 also shows the concrete lower end 211 embedded in the caisson 250.

FIGS. 9–11 show connectors for fastening together columns 210 and panels 230. Each panel 210 has a unistrut channel 240 cast therein, and each column 210 also has a unistrut channel 250 cast therein. A bolted connector 260 is fixedly disposed in both the unistrut channel 240 of each panel 130 and the unistrut channel 250 of each column 210, for securely connecting them together.

Although not shown, this concept of the channels cast in the panels and columns and having bolt connections to secure the panels to the columns can also be used in the embodiment shown in FIGS. 1–7.

As shown in FIG. 12, each panel 230 is shaped as a parallelogram for contouring the sound barrier 200 to the particular grade of the landscape.

FIGS. 13–19 show still another alternative embodiment of a sound barrier 300. In FIGS. 13–19 features similar to the embodiment in FIGS. 1–6 and 7–12 are similarly numbered.

As shown in FIG. 13, the sound barrier 300 includes steel columns 310, each having a steel base plate 320 welded thereto. The steel base plate 320 has apertures (not labelled) for bolts 322 to pass through and extend into a caisson 330.

FIG. 15 shows each column 310 having the bolts 322 embedded in the caisson 330, which is itself reinforced by a steel cage 332.

FIGS. 16 and 18 shows the sound barrier 300 with a nonshrink leveling grout 380 with a depth of one inch which separates the steel plate 320 and the caisson 350 (not shown), and a nonshrink mortar step 375 which separates a bottom panel 330 and the caisson 350 (not shown) for raising the height of the sound barrier 300.

FIG. 17 shows that each steel column 310 is shaped as an "H" and has recessed grooves 312, 314. The steel base plate 320 is welded thereto with the bolts 322 in place.

FIG. 19 shows that the sound barrier 300 includes a steel column 310 as a corner column 310' having recessed grooves 312' and 314' arranged at a 90 degree angle.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween. It should also be understood that features described with respect to one embodiment may be used as features in another embodiment.

What is claimed is:

1. An elongated outdoor acoustic barrier for erection along a roadway or the periphery of an airport, for reflecting and absorbing sounds emanating from the roadway or airport, comprising:

a plurality of substantially vertical columns arrayed at spaced intervals along the barriers' length, each having a recessed groove extending along its exposed above-ground lateral surface facing an adjacent spaced column; and a plurality of elongated flat rectangular panels arranged in a vertical edgewise array at least one panel in height, having opposite panel ends each securely embraced in a respective recessed grooves of a pair of adjacent columns, at least one of said panels being an extruded pre-stressed hollow core concrete panel having a plurality of substantially parallel longitudinal passages extending throughout and having a plurality of prestressed reinforcement strands embedded therein and arranged between adjacent pairs of the substantially parallel longitudinal passages.

2. The acoustic barrier defined in claim 1, wherein each of the substantially parallel longitudinal passages has an elliptical cross-section.

3. The acoustic barrier defined in claim 1, wherein at least one of said panels has a coating layer of sound absorbing material affixed to at least one face thereof facing the direction of a source of sound to be absorbed.

4. The acoustic barrier defined in claim 3, wherein the sound barrier has a noise reduction factor of at least about 0.5, and preferably 0.8–0.85.

5. The acoustic barrier defined in claim 1, wherein each column is formed of solid concrete incorporating lengthwise reinforcing bars positioned by spacer grids.

6. The acoustic barrier defined in claim 1, wherein each column has a lower end firmly embedded in a caisson below grade.

7. The acoustic barrier defined in claim 6, wherein the lower end firmly embedded in the caisson is a reinforced steel cage.

8. The acoustic barrier defined in claim 1, wherein said plurality of panels includes four panels stacked edgewise in a vertical array between each adjacent pair of columns.

9. The acoustic barrier defined in claim 1, wherein each of said panels has a tongue on one edge and a groove on its opposing edge so that when two panels are stacked on top of one another, a tongue of one panel engages a groove of another panel.

10. The acoustic barrier defined in claim 1, wherein at least one of said panels has a random horizontal scored pattern for deflecting the sounds emanating from the roadway or airport.

11. The acoustic barrier defined in claim 1, wherein at least one of said panels has an equally spaced horizontal ribbed pattern.

12. The acoustic barrier defined in claim 1, wherein at least one of said panels is shaped as a parallelogram.

13. The acoustic barrier defined in claim 1, wherein at least one of said columns is a concrete post for extending into a caisson.

14. The acoustic barrier defined in claim 13, wherein the sound barrier includes a nonshrink leveling grout for separating a bottom panel from the caisson.

15. The acoustic barrier defined in claim 1, wherein at least one of said columns is H-shaped with opposing recessed grooves.

16. The acoustic barrier defined in claim 1, wherein the recessed grooves are shaped rectangularly and dimension for receiving the panel end while leaving at least a one half inch space to account for expansion.

17. The acoustic barrier defined in claim 6, wherein the sound barrier includes a nonshrink mortar step for separating a bottom panel from the caisson for grading the sound barrier.

18. The acoustic barrier defined in claim 1, wherein at least one of said columns is a corner post with recessed grooves arranged at an angle of ninety degrees.

19. The acoustic barrier defined in claim 1, wherein at least one of said panels has a unistrut channel cast therein, wherein at least one of said columns has a unistrut channel cast therein, and wherein the sound barrier further includes a bolted connection arranged in the unistrut channels of said at least one of said panels and said at least one of said columns, for coupling them together.

20. The acoustic barrier defined in claim 1, wherein at least one of said columns is a steel column with a base plate welded thereto with at least one aperture therein for receiving a bolt which extends into a caisson.

* * * * *